US008429862B2

(12) United States Patent
Yin

(10) Patent No.: US 8,429,862 B2
(45) Date of Patent: Apr. 30, 2013

(54) VIBRATION DAMPING CONSTRUCTION SYSTEM

(75) Inventor: Samuel Yin, Taipei (TW)

(73) Assignee: Ruentex Engineering & Construction Co., Ltd., Taipei (TW)

( * ) Notice: Subject to any disclaimer, the term of this patent is extended or adjusted under 35 U.S.C. 154(b) by 326 days.

(21) Appl. No.: 12/701,564

(22) Filed: Feb. 7, 2010

(65) Prior Publication Data

US 2011/0037209 A1 Feb. 17, 2011

(30) Foreign Application Priority Data

Aug. 11, 2009 (TW) ..... 98126996 A

(51) Int. Cl.
*E04B 1/98* (2006.01)
*E04H 9/02* (2006.01)

(52) U.S. Cl.
USPC ..... 52/167.4; 52/167.1; 52/167.6; 52/167.8; 248/638; 248/636

(58) Field of Classification Search ..... 52/167.3, 52/167.4, 167.6, 167.8, 167.1, 167.2; 248/638, 248/188.1, 636
See application file for complete search history.

(56) References Cited

U.S. PATENT DOCUMENTS 4,330,103 A * 5/1982 Thuries et al. ..... 248/548
4,599,834 A * 7/1986 Fujimoto et al. ..... 52/167.8
4,679,775 A * 7/1987 Funaki et al. ..... 267/64.27
4,783,937 A * 11/1988 Sato ..... 52/168
4,883,250 A * 11/1989 Yano et al. ..... 248/638
4,910,930 A * 3/1990 Way ..... 52/167.1
5,016,409 A * 5/1991 Sato ..... 52/167.2
5,267,633 A * 12/1993 Endo et al. ..... 188/267.1
5,447,001 A * 9/1995 Nishimura et al. ..... 52/167.2
5,450,931 A * 9/1995 Masuda et al. ..... 188/268
5,487,534 A * 1/1996 Sakamoto et al. ..... 267/141.1
5,780,943 A * 7/1998 Ono ..... 310/12.06
6,038,013 A * 3/2000 Ohsaki ..... 355/53
6,116,784 A * 9/2000 Brotz ..... 384/99
6,150,787 A * 11/2000 Lee ..... 318/649
6,216,991 B1 * 4/2001 Okamoto ..... 248/188.1
6,327,024 B1 * 12/2001 Hayashi et al. ..... 355/53
6,392,741 B1 * 5/2002 Mori et al. ..... 355/53
6,731,372 B2 * 5/2004 Binnard et al. ..... 355/53
6,825,635 B2 * 11/2004 Kato ..... 318/649
7,095,482 B2 * 8/2006 Phillips et al. ..... 355/53
7,726,452 B2 * 6/2010 Kraner ..... 188/378
8,047,512 B2 * 11/2011 Mizushima et al. ..... 267/140.14

FOREIGN PATENT DOCUMENTS

CN 101289868 A 10/2008
JP S52-009404 1/1977
JP 2002-242990 8/2002

OTHER PUBLICATIONS

Office Action of Counterpart Application cited by China Patent Office on Feb. 3, 2012.
Office action of counterpart application by Japan Patent Office on Oct. 4, 2011.

* cited by examiner

*Primary Examiner* — Joshua J Michener
*Assistant Examiner* — Chi Q Nguyen

(57) ABSTRACT

The present invention provides a vibration damping construction system including a first construction body, a second construction body, and a damping unit. The first construction body includes a reaction surface. The second construction body is accommodated in the first construction body. The damping unit is disposed between the second construction body and the reaction surface of the first construction body for reducing the vibration transferred from the first construction body.

11 Claims, 7 Drawing Sheets

VIBRATION DAMPING CONSTRUCTION SYSTEM

This application claims the priority based on a Taiwanese patent application No. 098126996, filed on Aug. 20, 2009, the disclosure of which is incorporated herein by reference in its entirety.

BACKGROUND OF THE INVENTION

1. Field of the Invention

The present invention generally relates to a vibration damping construction system. Particularly, the present invention relates to a vibration damping construction system for eliminating or reducing environmental micro vibrations.

2. Description of the Prior Art

Damping devices applied to construction members or structures, vehicles including motorbikes or automobiles, etc. will have different configurations based on their applications. For example, the damping device designed for construction members such as door, furniture, or cabinet generally includes a housing tube having a channel, a piston, disposed in the channel, capable of axially moving back and forth with respect to the housing tube, and a piston rod connected to the piston. When closing the door, the piston and the piston rod slide with respect to the housing tube to drive the fluid in the housing tube. With such a design, the door can move faster at the beginning and then slower as approaching the complete close so that the vibration damping effect can be achieved.

Although a variety of damping devices are available in the market, those damping devices are not specifically provided for micro-vibrations of about several Hertz (Hz), particularly 3 Hz. In view of the above-mentioned defects, a system for damping micro-vibrations is desired.

SUMMARY OF THE INVENTION

It is an object of the present invention to provide a vibration damping construction system for reducing environmental micro-vibrations.

It is another object of the present invention to provide a vibration damping construction system for the disposition of precision instruments.

The vibration damping construction system of the present invention includes a first construction body, a second construction body, and a damping unit. The first construction body includes a reaction surface. The second construction body is accommodated in the first construction body. The damping unit is disposed between the second construction body and the reaction surface of the first construction body. The damping unit can receive a reaction force from the reaction surface to support the second construction body and absorb vibrations transferred from the first construction body. Besides, the reaction force received by the damping unit can compensate for vertical micro-vibrations caused by an external force.

DETAILED DESCRIPTION OF THE PREFERRED EMBODIMENT

Figure 1:
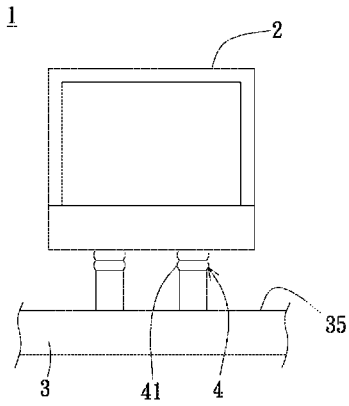
FIG. 1 shows a schematic view of one embodiment of the vibration damping construction system.

In the embodiment shown in FIG. 1, the vibration damping construction system 1 of the present invention includes a first construction body 3, a second construction body 2, and a damping unit 4. In this embodiment, the first construction body 3 includes a reaction surface 35. The reaction surface 35 is a surface for providing a reaction force. In particular, the reaction surface 35 is a virtual surface, which will change its position in response to the location of its supporting target object. Thus, in other embodiments, the location of the reaction surface 35 can be different. The damping unit 4 is disposed between the second construction body 2 and the reaction surface 35 of the first construction body 3. In particular, the damping unit 4 can be an air cushion or air spring 41, which is supported by a supporting column. In this case, the supporting column can be considered as an extension of the air spring 41. Thus, the damping unit 4 includes the air spring 41 and the supporting column. In such an arrangement, the reaction surface 35 is located under the air spring 41 and the supporting column. The air spring 41 is preferably an O-shaped air spring (from cross-sectional view). However, the shape and structure of the air spring 41 can be modified according to different embodiments and designs. In particular, the air spring 41 can include a supporter and other air spring parts. The internal air pressure of the air spring 41 can be about 1 to 10 bar. In another embodiment, the damping unit 4 can include several air springs 41 stacked together to adjust the reaction force. As shown in FIG. 1, the air spring 41 includes double layers of air springs; however, in other embodiments, the number of layer of the air spring 41 is not limited thereto. In this embodiment, the air spring 41 supports the second construction body 2 by the reaction force, which is resulted from the air density and the air tension so as to absorb vibrations from the first construction body 3. Specifically, by adjusting the air pressure of the air spring 41, the micro vibration induced by the external force in the vertical direction can be absorbed. In the embodiment shown in FIG. 1, the second construction body 2 can be a laboratory, a stage for supporting precision instruments, an operating room of hospital, a semiconductor processing site, or other constructions or places required of reducing vibrations of about 3 to 100 Hz.

Figure 2:
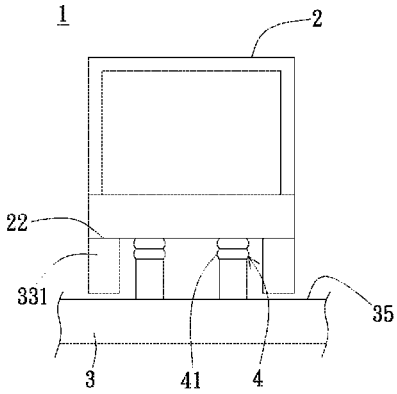
FIG. 2 shows a schematic view of another embodiment of the vibration damping construction system.
Figure 3:
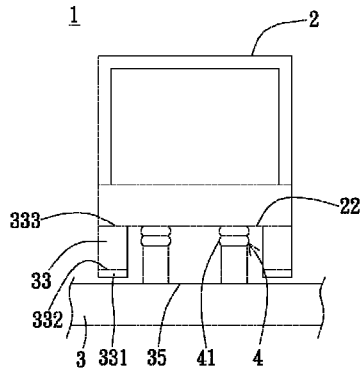
FIG. 3 shows a schematic view of one embodiment of a modified vibration damping construction system.

In the embodiment shown in FIG. 2, the vibration damping construction system 1 further includes a cushion pad 331. The cushion pad 331 serves as a buffer to alleviate the pressure exerted on the second construction body 2. The cushion can be disposed under the second construction body 2 or any desired position. For example, in this embodiment, the cushion pad 331 is disposed on the bottom surface 22 of the second construction body 2. However, in other embodiments, the cushion pad 331 can be disposed on the lateral surface of the second construction body 2 or on the reaction surface 35 of the first construction body 3 to reduce the vibration impact on the second construction body 2. The material of the cushion pad 331 is preferably selected from the group consisting of foams, resilient polystyrene plastics, and other material capable of absorbing shock. The shape of the cushion pad 331 is preferably a cubic columnar shape; however, in other embodiments, the shape of the cushion pad 331 can be rectangular, circular, or other geometry shapes. In the embodiment shown in FIG. 3, the vibration damping construction system 1 further includes a pier 33. The cushion pad 331 is disposed on the bottom surface 332 of the pier 33. The top surface 333 of the pier 33 is connected to the bottom surface 22 of the second construction body 2. However, in another embodiment, the pier 33 can be connected to the reaction surface 35, while the cushion pad 331 is disposed on the top surface 333 of the pier 33 for absorbing the shock from the second construction body 2 relative to the reaction surface 35.

Figure 4:
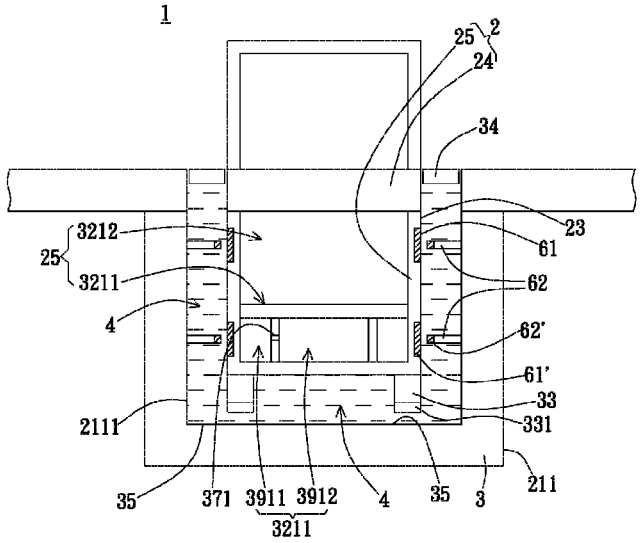
FIG. 4 shows a schematic view of another embodiment of a modified vibration damping construction system.

In the embodiment shown in FIG. 4, the second construction body 2 is accommodated in the first construction body 3. The damping unit 4 can be a fluid which is preferably water. However, in other embodiments, the fluid can be saturated liquids or non-saturated liquids. In this embodiment, the first construction body 3 further includes a groove wall 2111. The groove wall 2111 upwardly extends from the reaction surface 35 and together with the reaction surface 35 to define a groove 211. The damping unit 4 and a portion of the second construction body 2 are accommodated in the groove 211. Specifically, the damping unit 4 (such as water) surrounds a portion of the second construction body 2 to provide the second construction body 2 with the reaction force for absorbing vertical vibrations induced by the external force. As shown in FIG. 4, the vibration damping construction system 1 further includes at least a floater 34. The floater 34 is disposed in the groove 211 between the sidewall 23 of the second construction body 2 and the groove wall 2111 to prevent the damping unit 4 (such as water) from loss and to prevent people who enter or exit the second construction body 2 from accidentally falling into the space between the second construction body 2 and the groove wall 2111. The floater 34 is preferably a single layer disposed on the damping unit 4. The floaters 34 are preferably connected to each other by iron chains or other metal engaging members. However, in another embodiment, the floater 34 can include two or more layers stacked together on the damping unit 4. The material of the floater 34 is preferably foam rubber. However, in other embodiments, the floater 34 can be made of plastics or other materials which can be disposed over the damping unit 4.

As shown in FIG. 4, the second construction body 2 includes a base 24 and a lower concrete structure 25. The lower concrete structure 25 connects to the base 24. The lower concrete structure 25 includes at least one chamber 3211 and at least one gas chamber 3212. The chamber 3211 connects to the gas chamber 3212 for adjusting the center of gravity of the second construction body 2 and the lower concrete structure 25 in order to maintain the balance of the second construction body 2. For example, the gas density of the gas chamber 3212 can affect the location of the center of gravity of the chamber 3211 to balance the lower concrete structure 25. In different embodiments, the lower concrete structure 25 can be modified to have different machinery according to different design structure and balancing requirements.

As shown in FIG. 4, the lower concrete structure 25 includes at least a chamber 3211 and a gas chamber 3212. The chamber 3211 introduces or discharges the damping unit 4 (such as water) to adjust the level or the center of gravity of the second construction body 2 so as to absorb vibrations from environment and to position precision instruments. In other words, the damping unit 4 (such as water) can flow into or flow out of the chamber 3211. In this embodiment, the chamber 3211 includes a first chamber unit 3911 and a second chamber unit 3912. The first chamber unit 3911 is communicated with the second chamber unit 3912 through a cut-off valve 371. By means of the cut-off valve 371, the lower concrete structure 25 can precisely adjust the ratio of the damping unit 4 (such as water) contained in the first chamber unit 3911 and in the second chamber unit 3912 to adjust the level or the center of gravity of the second construction body 2 or the lower concrete structure 25. However, in other embodiments, the number of the chamber units is not limited to this embodiment. Moreover, air can be discharged from or introduced into the gas chamber 3212 to adjust the level or the center of gravity of the lower concrete structure 25 or the second construction body 2.

As shown in FIG. 4, the vibration damping construction system 1 further includes at least a first repulsive unit 61 and a second repulsive unit 62. The first repulsive unit 61 is preferably embedded in the second construction body 2 which is in the groove 211. The second repulsive unit 62 protrudes from the groove wall 2111 corresponding to the first repulsive unit 61. The distance between the first repulsive unit 61 and the second repulsive unit 62 is smaller than or equal to the distance between the groove wall 2111 and the second construction body 2 to maintain the spatial position of the second construction body 2. In this embodiment, the second repulsive unit 62 has a structure protruding from the groove wall 2111; however, in other embodiments, the shape or structure of the second repulsive unit 62 is not limited to this embodiment. The second repulsive unit 62 can be embedded in the groove wall 2111 to provide a smooth surface on the embedded groove wall 2111. In addition, a certain repulsive force exists between the first repulsive unit 61 and the second repulsive unit 62 to maintain the spatial relative position of the second construction body 2. Specifically, the first repulsive unit 61 can be a magnetic bar 61', while the second repulsive unit 62 can be magnet 62'. The magnet 62' has the same magnetic pole as the magnetic bar 61' to provide a horizontal repulsive force for positioning the second construction body 2.

Figure 5:
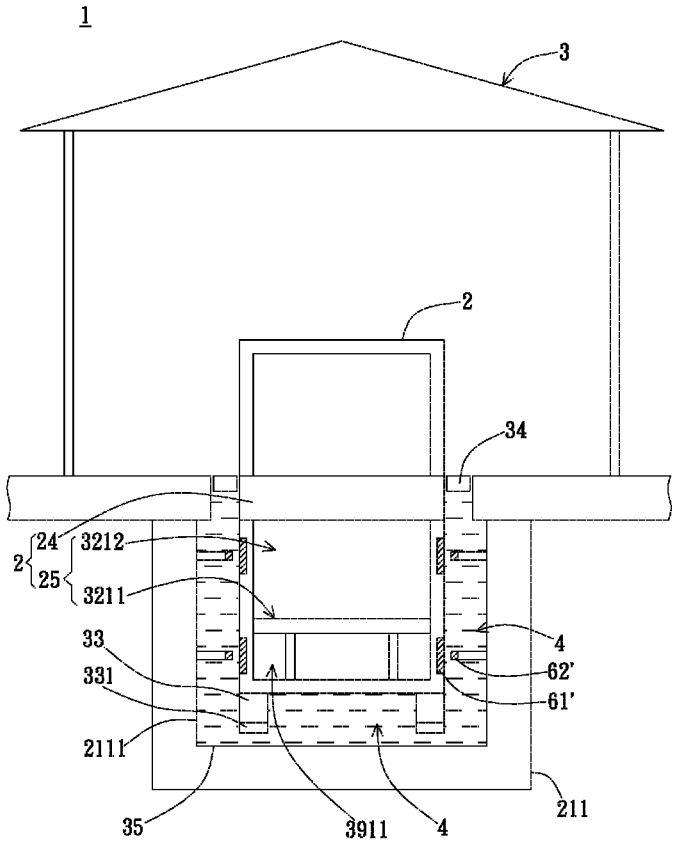
FIG. 5 shows a schematic view of an embodiment of the vibration damping construction system.

In the embodiment shown in FIG. 5, the vibration damping construction system 1 includes the second construction body 2, the first construction body 3, and the damping unit 4. The first construction body 3 can be a house, a villa, a dormitory, a hotel, a boarding house, a business building, a factory, a hospital, a station, an airport, or other complex buildings. As shown in FIG. 5, the first construction body 3 includes the groove 211. In the embodiment, the groove 211 is disposed below the ground of the first construction body 3; however, in other embodiments, the groove 211 can be disposed above the ground according to different construction designs and is not limited to the coverage of the first construction body 3. As shown in FIG. 5, the groove 211 includes a groove wall 2111 and a reaction surface 35. The groove 211 defined by the groove wall 2111 and the reaction surface 35 can have a circular shape, but not limited to this shape. The groove 211 can be shaped as other geometries such as rectangle, triangle, and ellipse (see details of FIG. 9).

In the embodiment shown in FIG. 5, the lower concrete structure 25 includes a chamber 3211 and a gas chamber 3212. The gas chamber 3212 is connected to the chamber 3211. By introducing air into or discharging air from the gas chamber 3212, the gas chamber 3212 can regulate the volume or steam pressure of water (acting as the damping unit 4) to adjust the center of gravity and absorb micro vibrations from environment to facilitate the disposition of precision instruments. Specifically, in this embodiment, the chamber 3211 can be a water box which can be separated into different sections. Each section of the chambers 3211 can be respectively regulated to introduce or discharge fluid (such as water) to adjust the level or the center of gravity of the second construction body 2 or the lower concrete structure 25. Moreover, in this embodiment, the first construction body 3 and the second construction body 2 can be designed in a circular shape, but not limited to this embodiment. The first construction body 3 and the second construction body 2 can be connected to form a concrete structure in various geometries such as square, rectangle, triangle, and oval shapes so that the precision instruments can be disposed therein.

In this embodiment, the arrangements and functions of floaters 34, piers 33, damping units 4, and cushion pads 331 are similar to those described above. In this embodiment, the magnet 62' is disposed in the protruding end of the groove wall 2111 of the first construction body 3; the magnetic bar 61' is embedded in the second construction body 2 corresponding to the magnet 62'. The magnetic pole of the magnet 62' is the same as the magnetic bar 61'. Thus, the repulsive force is provided between the magnet 62' and the magnetic bar 61' to achieve the effect described above. Specifically, if the magnetic pole of the magnet 62' is N pole, the magnetic pole of the magnetic bar 61' is also N pole. Therefore, the repulsive force between the magnet 62' and the magnetic bar 61' can absorb horizontal micro vibrations to maintain the horizontal position of the second construction body 2. However, in another embodiment, the magnetic pole of the magnet 62' and the magnetic pole of the magnetic bar 61' can be different. In such an embodiment, the vibration damping construction system 1 is subjected to the attraction forces between the magnets 62' and the magnetic bars 61' on opposite sides, and therefore the micro vibrations in the horizontal direction can be absorbed to maintain the horizontal position.

Figure 6:
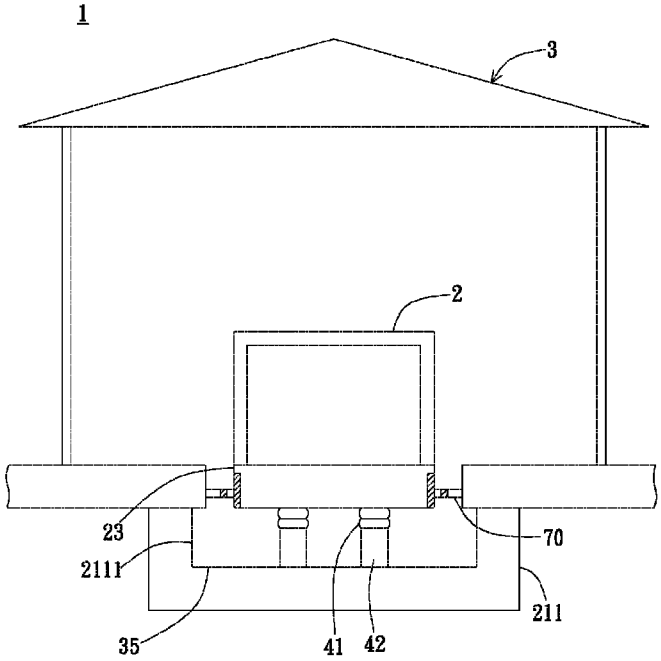
FIG. 6 shows a schematic view of another embodiment of the vibration damping construction system.

In the embodiment shown in FIG. 6, the damping unit 4 can be an air cushion 41. In this embodiment, the air cushion 41 is preferably supported by an air cushion column 42. The air cushion column 42 is preferably disposed between the reaction surface 35 and the second construction body 2. However, in other embodiments, the air cushion column 42 can be disposed on the groove wall 2111 or the sidewall 23 of the second construction body 2, and the air cushion 41 is disposed between the groove wall 2111 and the sidewall 23 to adjust the component of horizontal shear force and facilitates the operation of the magnet 62' and the magnetic bar 61'. The air amount contained in the air cushion 41 can be controlled by using other devices such as an electrical-controlled vent to absorb the vibrations and adjust the level and the center of gravity of second construction body 2. In another embodiment, the damping unit 4 can be magnetic devices having the same magnetic pole. The magnetic devices can be respectively disposed on the bottom surface 22 of the second construction body 2 and the reaction surface 35 to provide a stable reaction force for absorbing vertical micro vibrations. In this embodiment, the vibration damping construction system 1 further includes at least a flexible damping rope 70, which is connected between the second construction body 2 and the groove wall 2111. The rope 70 can be made of materials capable of absorbing shock such as foams, resilient polystyrene plastics, and the like.

Figure 7:
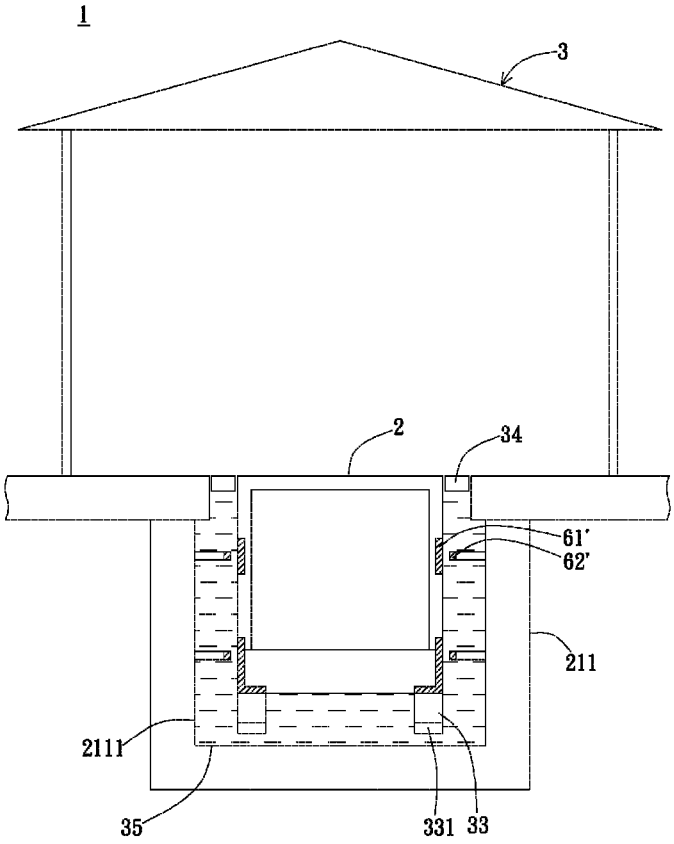
FIG. 7 shows a schematic view of an embodiment of the lower concrete structure.

In the embodiment shown in FIG. 7, the second construction body 2 can be disposed below the ground of the first construction body 3, preferably coplanar with the ground. In this embodiment, the number of the magnet 62' and the magnetic bar 61' can be increased to enhance the stability of the vibration damping construction system 1. For example, the vibration damping construction system 1 of FIG. 7 is more stable than the vibration damping construction system 1 of FIG. 5 due to the increased number of magnetic devices 61' and 62'. With such an arrangement, the lower concrete structure 25 can be omitted in the embodiment of FIG. 7 without substantially impairing its effect and therefore, the cost can be significantly reduced due to the omission of the lower concrete structure 25.

Figure 8:
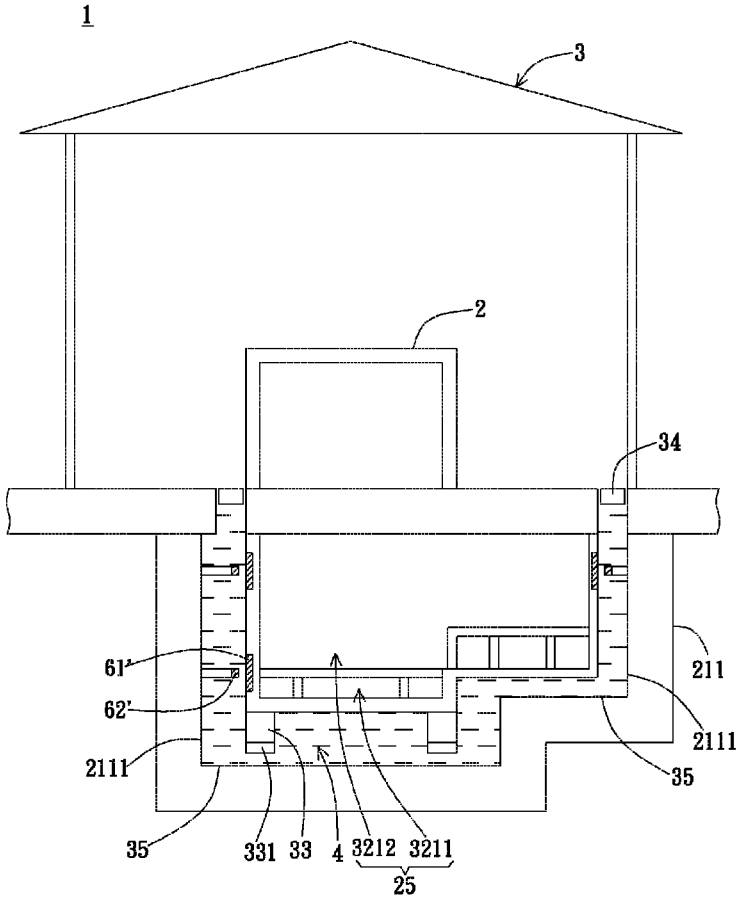
FIG. 8 shows a schematic view of another embodiment of the lower concrete structure.

In the embodiment shown in FIG. 8, the lower concrete structure 25 includes at least a chamber 3211 and a gas chamber 3212. This embodiment has a bigger lower concrete structure 25 including a variety of chamber 3211 to effectively adjust the level or the center of gravity of the second construction body 2.

Figure 9:
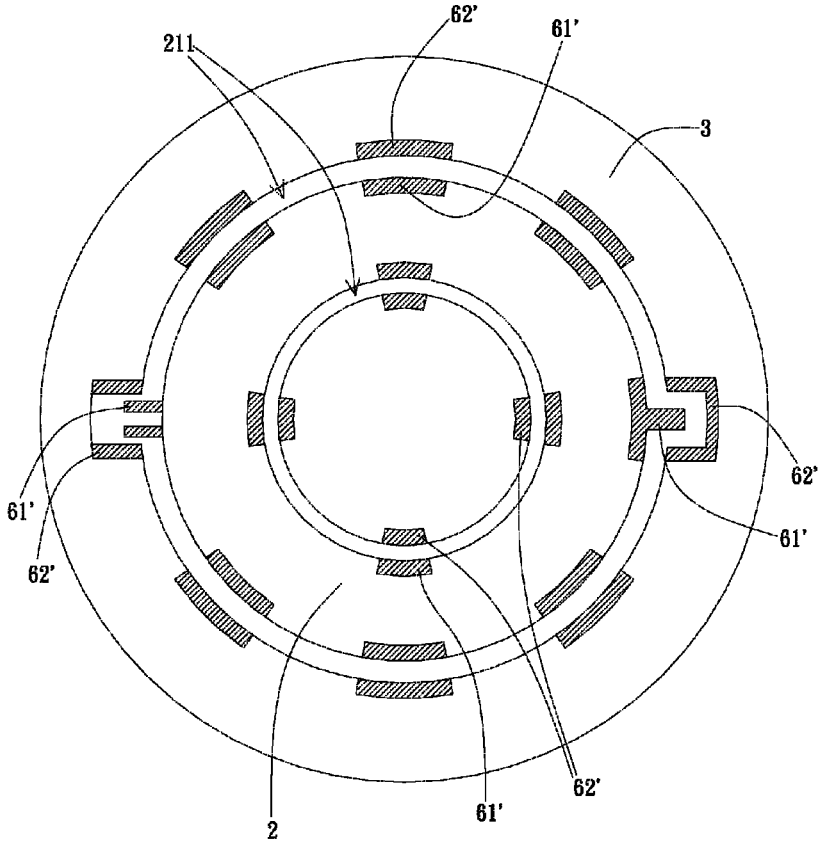
FIG. 9 presents a top view of an embodiment of the vibration damping construction system.

In the embodiment shown in FIG. 9, since the second construction body 2 is not directly connected to the first construction body 3, the micro vibrations can be absorbed by the repulsive force between the first construction body 3 and the second construction body 2. The second construction body 2 is accommodated in the groove 211. In this embodiment, the outer contour of the first construction body 3 is not illustrated; in other words, only the circular groove 211 for accommodating the second construction body 2 therein is presented. However, in other embodiments, the groove 211 and the second construction body 2 can be designed in oval shape, triangle shape, or polygon shape to prevent the second construction body 2 from rotating with respect to the center of circle. In the embodiment shown in FIG. 9, the magnet 62' and the magnetic bar 61' can have corresponding shapes. For example, the magnet 62' and the magnetic bar 61' can be designed as an engaging structure like mortise and tenon, but not limited to this embodiment. Thus, the relative position of the second construction body 2 and the first construction body 3 will not be changed due to rotation. However, in another embodiment, the second construction body 2 and the first construction body 3 can be designed to have other shapes such as oval shape or triangle shape to prevent the second construction body 2 and the first construction body 3 from rotating with respect to each other.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A vibration damping construction system, comprising:

a first construction body having a reaction surface and a groove wall, wherein the groove wall upwardly extends from the reaction surface and together with the reaction surface to define a groove;

a second construction body having a base and a lower concrete structure, wherein the lower concrete structure is connected to the base and includes a chamber and a gas chamber, the chamber is connected to the gas chamber; and a damping unit disposed between the second construction body and the reaction surface, wherein the damping unit is a fluid and is disposed between the groove wall and the lower concrete structure, and the damping unit receives a reaction force from the reaction surface to support the second construction body and to absorb a vibration from the first construction body, wherein the damping unit can be introduced into or discharged from the chamber or gas can be introduced into or discharged from the gas chamber to adjust a center of gravity of the second construction body so as to absorb vibrations from environment.

2. The vibration damping construction system of claim 1, wherein the damping unit and at least a portion of the second construction body are accommodated in the groove.

3. The vibration damping construction system of claim 2, further comprising at least a first repulsive unit and a second repulsive unit, wherein the first repulsive unit is disposed in the portion of the second construction body accommodated in the groove, the second repulsive unit is disposed on the groove wall corresponding to the first repulsive unit, a distance between the first repulsive unit and the second repulsive unit is smaller than or equal to a distance between the groove wall and the second construction body.

4. The vibration damping construction system of claim 3, wherein the first repulsive unit is a magnetic bar, the second repulsive unit is a magnet, the magnet and the magnetic bar have a same magnetic pole.

5. The vibration damping construction system of claim 2, further comprising at least a flexible damping rope, and wherein the rope is connected between the second construction body and the groove wall.

6. The vibration damping construction system of claim 2, further comprising at least a floater, the floater is disposed between the groove wall and a sidewall of the second construction body.

7. The vibration damping construction system of claim 1, further comprising a magnet and a magnetic bar, wherein the magnet is disposed in a protruding end of the groove wall corresponding to the second construction body, the magnetic bar is disposed in the second construction body corresponding to the magnet, and the magnet and the magnetic bar have a same magnetic pole.

8. The vibration damping construction system of claim 1, wherein the chamber includes a first chamber unit and a second chamber unit, the first chamber unit is communicated with the second chamber unit through a cut-off valve.

9. The vibration damping construction system of claim 1, further comprising at least a cushion pad, wherein the cushion pad is disposed under the second construction body.

10. The vibration damping construction system of claim 9, further comprising a pier, wherein the cushion pad is disposed on a bottom surface of the pier, a top surface of the pier is connected to a bottom surface of the second construction body.

11. The vibration damping construction system of claim 1, wherein the fluid is selected from the group consisting of water, saturated liquid, and non-saturated liquid.

* * * * *